US005187819A

United States Patent [19]

Grimes

[11] Patent Number: 5,187,819

[45] Date of Patent: Feb. 23, 1993

[54] TOILET POTS

[76] Inventor: Jane Grimes, Greenbanks, Linersh Wood Bramley, NR., Guildford, Surrey, England

[21] Appl. No.: 733,713

[22] Filed: Jul. 22, 1991

Related U.S. Application Data

[63] Continuation-in-part of Ser. No. 573,487, Aug. 27, 1990, abandoned.

[51] Int. Cl.[5] ..... A47K 11/04

[52] U.S. Cl. ..... 4/483; 4/484

[58] Field of Search ..... 4/449, 460, 476, 479, 4/483, 484; 297/439, 440, 461; 220/4.29, 6, 666; 16/227

[56] References Cited

U.S. PATENT DOCUMENTS

| | | | |
|---|---|---|---|
| 1,026,413 | 5/1912 | Sullivan | 4/460 |
| 1,428,627 | 9/1922 | Grabfelder | 4/483 X |
| 2,086,109 | 7/1937 | Albert | 4/483 X |
| 2,849,726 | 9/1958 | Vay | 4/476 |
| 2,893,017 | 7/1959 | Beck | 4/476 |
| 2,912,702 | 11/1959 | Mackenzie | 4/476 |
| 3,381,315 | 5/1968 | Glassberg | 4/484 |
| 3,422,985 | 1/1969 | Rinehart | 4/484 |
| 3,579,655 | 5/1971 | Sundberg | 4/476 |
| 3,600,719 | 8/1971 | Karr | 4/476 |
| 3,683,426 | 8/1972 | Lagstrom | 4/484 |
| 3,796,342 | 3/1974 | Sanders et al. | 220/6 |
| 4,710,989 | 12/1987 | Grenthe | 4/449 |
| 4,995,122 | 2/1991 | Mohnhaupt | 4/483 |

FOREIGN PATENT DOCUMENTS

| | | | |
|---|---|---|---|
| 377502 | 6/1964 | China | 4/476 |
| 98553 | 8/1898 | Fed. Rep. of Germany | 4/484 |
| 1584029 | 4/1970 | Fed. Rep. of Germany | 16/227 |
| 528453 | 10/1940 | United Kingdom | 4/460 |
| 920358 | 3/1963 | United Kingdom . | |
| 1180411 | 2/1970 | United Kingdom | 16/227 |

*Primary Examiner*—Henry J. Recla
*Assistant Examiner*—Robert M. Fetsuga
*Attorney, Agent, or Firm*—Kinney & Lange

[57] ABSTRACT

A toilet pot is comprised of four rigid or semi-rigid upright walls. The upright walls include two side walls opposing each other and a front wall and a rear wall opposing each other. Each side wall is formed of two panels hingedly connected together for folding inwardly. The upright walls together define a generally rectangular cavity. The front and rear walls are pivotably connected together with the opposing side walls. A seat member is hingedly connected to the upper edge of the rear wall for overlaying the generally rectangular cavity. The seat member is provided with side support walls which are hingedly connected thereto and capable of folding down along side the side walls such as to hold the side walls open when the toilet pot is in use. A removable fluid immersible lining bag is provided for insertion within the generally rectangular cavity defined by the upright walls. A second embodiment is disclosed having a removable seat member and alternative side wall support members.

3 Claims, 4 Drawing Sheets

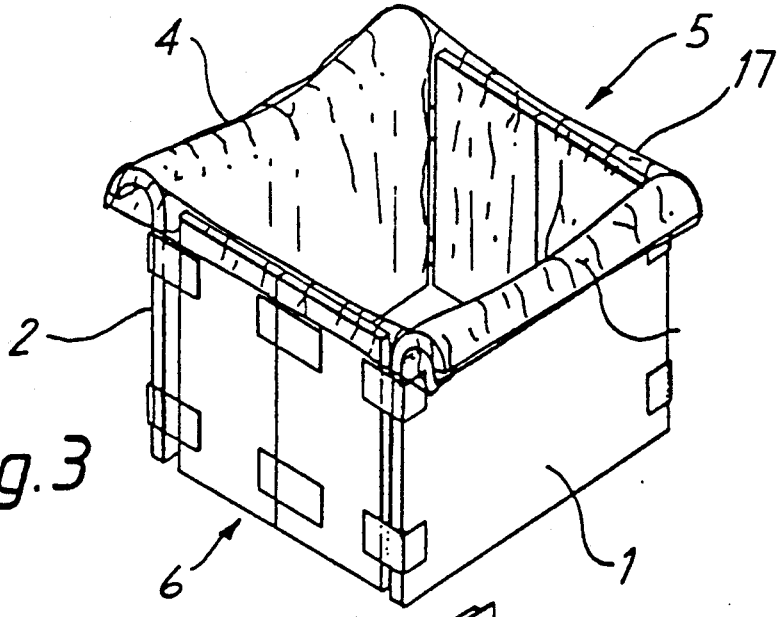
Fig.3
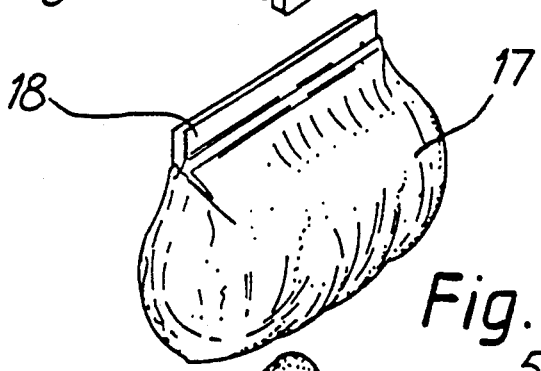
Fig.4
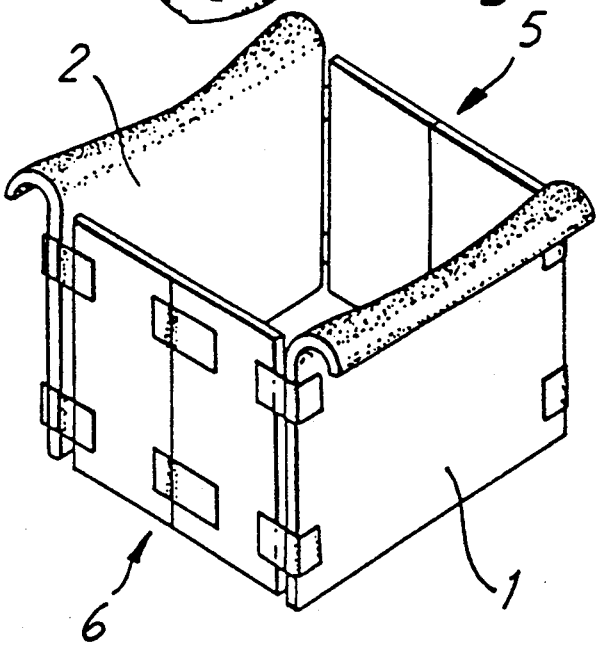

TOILET POTS

CROSS-REFERENCE TO COPENDING APPLICATION

This application is a continuation-in-part of U.S. Ser. No. 07/573,487, filed Aug. 27, 1990 now abandoned.

FIELD OF THE INVENTION

This invention relates to toilet pots and more especially to toilet or chamber pots for children, although it is also applicable to toilet pots for adults, such as invalids or disabled persons.

With the steadily increasing mobility of families and mothers, such as the ever expanding experience of leisure travel by motor cars or public transportation, it has of necessity become common practice for mothers and families with young children to cater for the childs toilet needs by travelling with an appropriate toilet or chamber pot.

Although such chamber pots can sometimes be easily and conveniently carried, say in the boot of a car, they can at other times, when in the passenger compartment of the car or when being transported during walking or on public transport for example, be considerably inconvenient in their bulkiness, as well as being of such an unsightly nature that they are often carried within a bulky plastic bag, for example.

DESCRIPTION OF PRIOR ART

U.S. Pat. No. 3,579,655 discloses a portable toilet structure in which sides are connectable and disconnectable, so that assembly and disassambly is relatively slow and cumbersome, and parts can readily be lost.

UK Patent 920,358 discloses a collapsible baby pot which is collapsible by simply bending the outer wall, with an assembly for holding a waste bag within the collapsed pot. Such an arrangement is cumbersome in use and intrinsically uncertain in its stability, as well as collapsing to what must remain a substantial bulk.

SUMMARY OF THE INVENTION

It is an object of the present invention to overcome or at least substantially reduce the above mentioned problems.

In accordance with one aspect of the invention there is provided a toilet pot comprising a structure including a plurality of rigid or semi-rigid upright walls, the walls comprising two side walls opposing each other, and a front wall and a rear wall opposing each other defining a generally rectangular cavity, the upright walls being pivotably connected together with two of the opposing walls formed of at least two panels separated on a generally vertical line hingedly connected together for folding inwardly whereby the structure may be folded into a "flat" configuration for carrying, means permanently linked to an upright wall being provided for holding the walls open in use, and a removable fluid impermeable lining bag being provided for insertion within the cavity defined by the upright walls.

By the expression "flat" as used herein is meant a folded configuration of the pot in which the walls lie closely together and approximately parallel to one another.

The structure may be folded to its "flat" configuration by folding the panels together and inwardly, so that when collapsed the multi-panelled walls lie between the other two walls.

In one arrangement the multi-panelled walls hingedly connected together may comprise the front and rear walls. In this case the side walls may, at their upper parts, be shaped to provide a comfortable firm seating for a child.

In accordance with another aspect of the present invention there is provided a toilet pot comprising a structure including four rigid or semi-rigid upright structure walls, the structure walls comprising two side walls opposing each other, and a front wall and a rear wall opposing each other, together defining a generally rectangular cavity, the upright walls being pivotably connected together with the opposing side walls formed of at least two panels hingedly connected together for folding inwardly, a seat member hingedly connected to the upper edge of the rear wall for overlying the generally rectangular cavity, the seat member being provided with side support walls hingedly connected thereto and capable of folding down alongside of the side structure walls and engaging with the panels of the side structure walls such as to hold the walls open in use, and a removable fluid impermeable lining bag being provided for insertion within the cavity defined by the upright walls.

The fluid impermeable lining bag is preferrably of a disposable nature and may be provided with included upper securing and sealing means. It may additionally be provided with an internal fluid absorbent lining or padding.

The chamber pot may be provided with a base, which may be in the form of a flexible material.

Alternatively the chamber pot may be provided with no separate base member at all.

The chamber pot may be formed of a suitable semi-rigid plastics material and may be provided with appropriate snap action hinges. The lining bag may be formed of a suitable flexible plastics material.

DESCRIPTION OF THE DRAWINGS

In order that the invention may be more readily understood, two embodiments thereof will now be described by way of example with reference to the accompanying drawings in which:

FIG. 3 shows the chamber pot of FIG. 2 with a disposable lining bag in position;

FIG. 4 shows the disposable lining bag in course of removal;

Referring now to FIGS. 1 to 4 of the drawings it will be seen that the toilet or chamber pot structure illustrated therein comprises two side walls 1,2 having shaped and turned over upper edges 3,4 to provide a comfortable seat for a child, and back and front walls 5,6 each in the form of two vertically divided panels 7,8, 9,10, connected together by snap action hinges 11,12, and similarly connected by snap action hinges 13,14,15,16, at their ends to the ends of the side walls. The snap action hinges may be designed to "lock", i.e. resist movement from their open dispositions. No base is usually needed or provided, although a base is shown at 23 in FIG. 1. The side and end walls are of semi-rigid plastics material.

Figure 1:
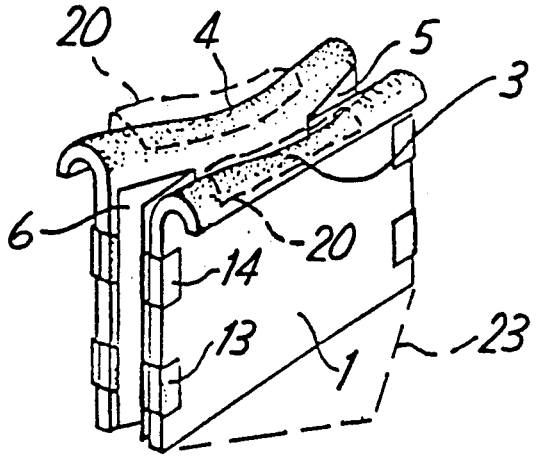
FIG. 1 shows one embodiment of a toilet or chamber pot in accordance with the invention in its folded condition.

As can be seen in FIG. 1, the front and rear walls 5,6 readily fold inwardly so as to provide a generally flat configuration of the pot for carrying and stowing when not in use. Padding 20 may be secured to the upper edges 3,4 of side walls 1,2 for extra comfort, the securement being detachable for cleaning purposes and being by means of "Velcro" interengaging fibre fasteners, for example.

Figure 2:
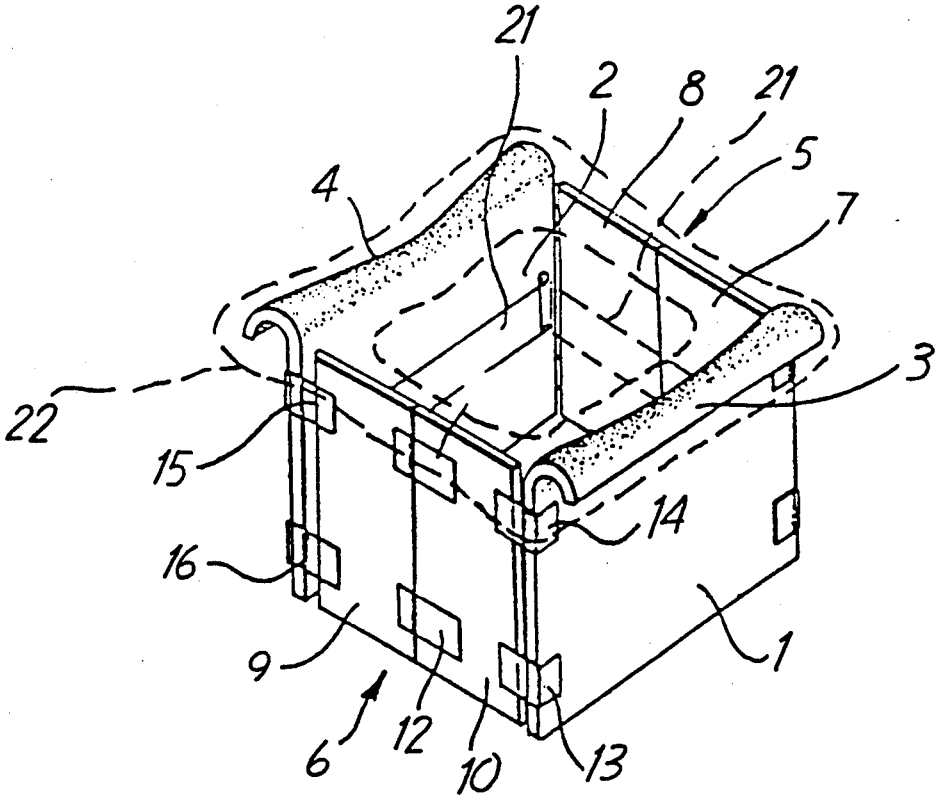
FIG. 2 shows the chamber pot of FIG. 1 in its open position.

Alternatively, as can be seen in FIG. 2, an attachable seat 22 may be provided for safety and comfort of the user.

To ensure the retention of the open nature of the pot when open, means permanently linked to an upright wall may be provided to hold the walls open. A form of such means is shown at 21 in FIG. 2 and comprises a hinged locking bar, storable against and mounted on side wall 2 when not in use but latchable across wall 5 to prevent this wall folding inwardly.

In FIG. 3, a disposable lining bag 17 of flexible fluid impermeable plastic having a fluid absorbent pad incorporated internally (not shown) has been fitted over the seat portions 3,4 of the side walls 1,2 so as to lie within the rectangular space defined by the structure. The top portion of the liner may be padded where it overlies edges 3,4 of the walls 1,2.

After use, the disposable lining bag 17 can be sealed by means of integral sealing strips 18 (of any convenient known kind) for disposal (see FIG. 4), whereafter the chamber pot can again be folded into its generally flat configuration as shown in FIG. 1.

Figure 5:
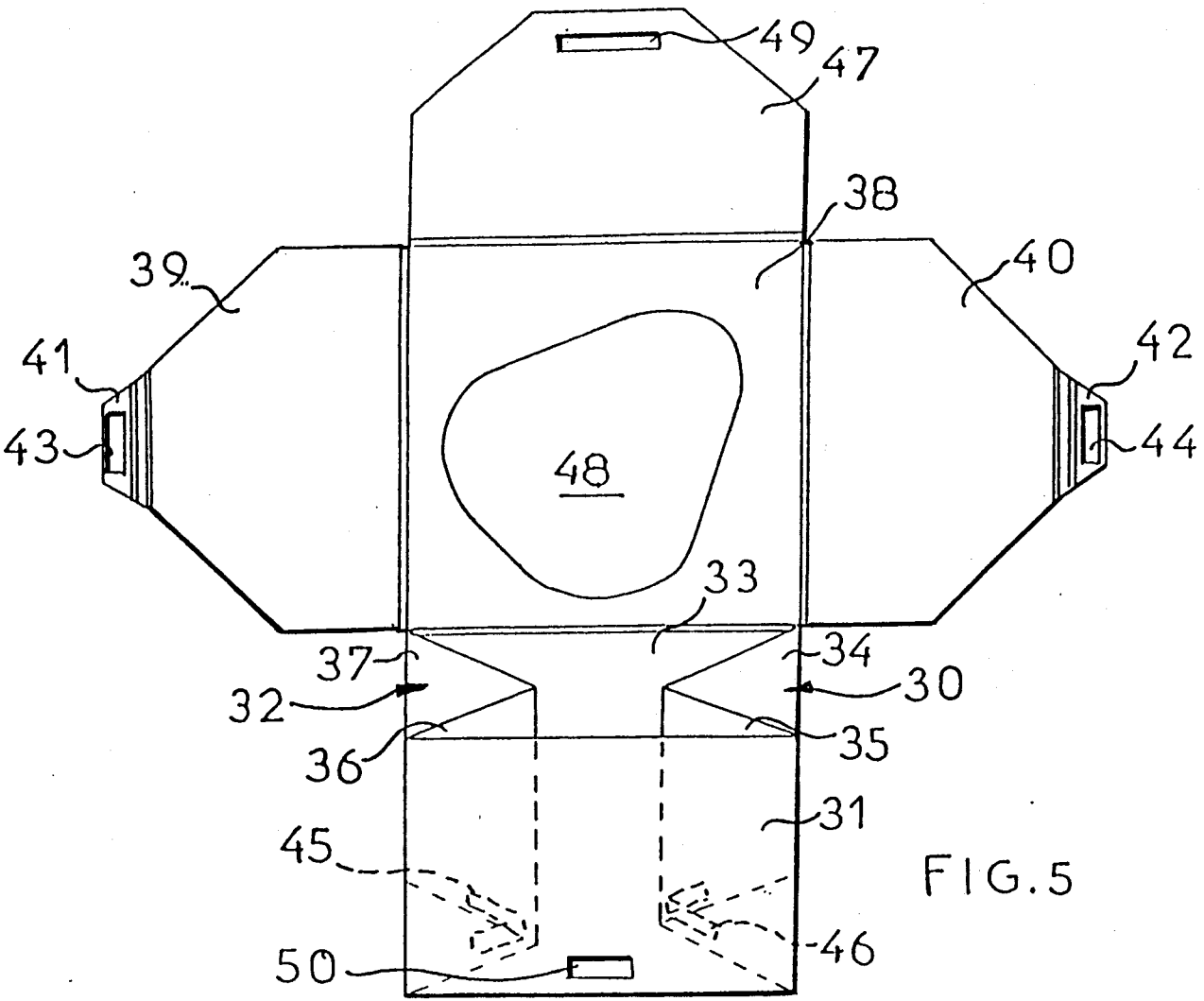
FIG. 5 shows a second embodiment of a toilet or chamber pot in accordance with the invention in an opened out disposition.
Figure 6:
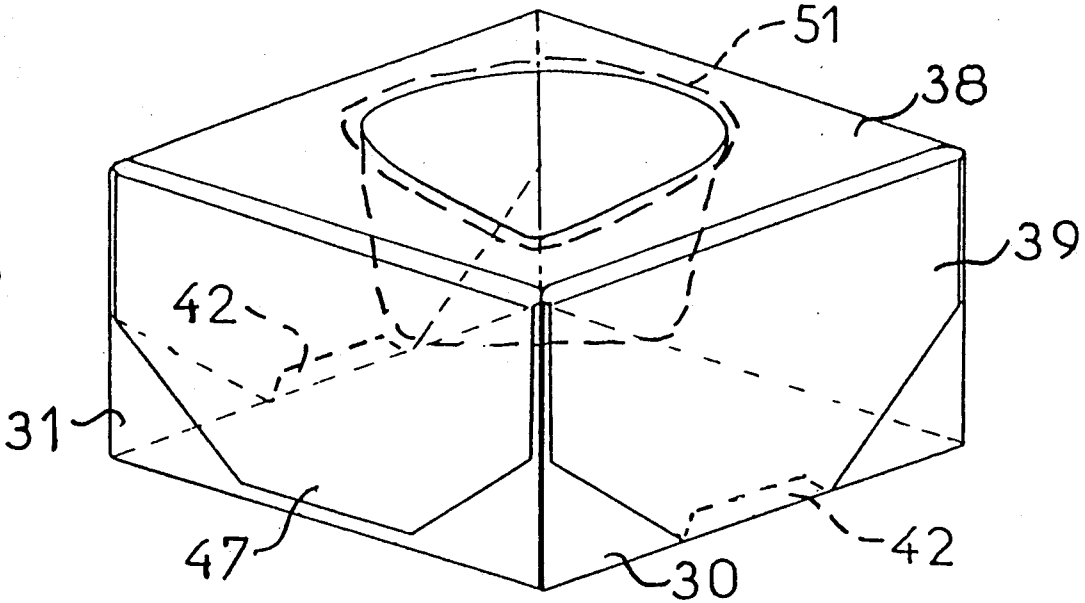
FIG. 6 shows the pot of FIG. 5 assembled ready for use.
Figure 7:
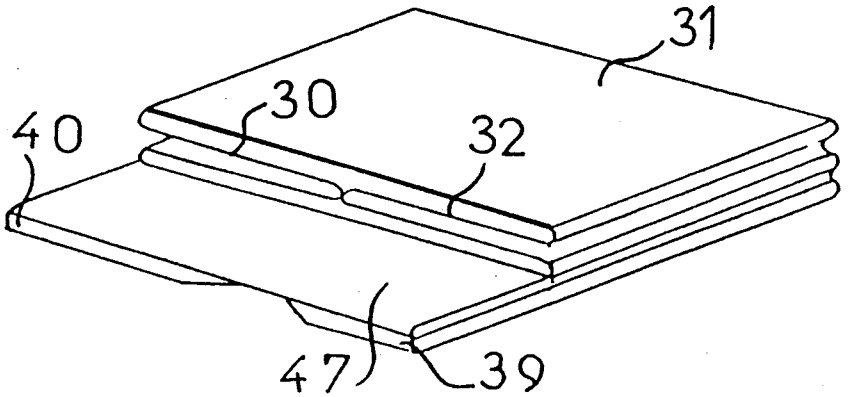
FIG. 7 shows the pot of FIG. 5 in its folded condition.

The arrangement of FIGS. 5, 6 and 7 has considerable similarity to that of FIGS. 1 to 4.

Thus, as can clearly be seen in FIG. 5 the structure has four upright structure walls 30,31,32,33, connected by fold lines, which may be formed of plastics material, or plastics covered hardboard for example. Two opposing walls 30,32 are in the form of two vertically divided panels 34,35,36,37 hingedly connected together by fold lines for folding inwardly as in the arrangement of FIGS. 1 to 4.

Additionally, as can best be seen in FIGS. 5 and 7, a seat member 38 is hingedly connected by a fold line to the upper edge of wall 33, the seat member being foldable across the structure walls 30,31,32,33 to the assembled condition shown in FIG. 6, as well as back against the outside of wall 33 for stacking as shown in FIG. 7.

The seat member 38 is provided with an appropriate opening 48 shaped for intended use with the user seated diagonally on the structure to maximize leg comfort. On two side edges of the seat member 38 are support walls 39,40, hingedly connected by fold lines and intended on assembly to fold down outside structure walls 30,32, tuck under flap portions 41,42 of the support walls 39,40 then locating under the structure walls 30,32 at the joint between panels 34,35 and 36,37. The flap portions 41,42 are provided with adhesive pads 43,44 for attachment to similar pads 45,46 on the inside of walls 32,30 on both sides of the joint hinge between panels 36,37 and 34,35. By this means great support for the structure when assembled is obtained, and the structure walls are held firmly in their open disposition when the pot is assembled. The support walls and flap portions therefore act as means permanently linked (indirectly) to an upright structure wall and provided to hold the walls open.

To add further strength to the structure an additional support wall 47 is hingedly connected by fold lines to the seat member 38 such as to fold, on assembly, outside wall 31, and be adhered thereto by means of adhesive pads 49,50.

As with the embodiment of FIGS. 1 to 4, a disposable lining bag 51 is provided for the assembled structure.

To fold the structure from the assembled condition of FIG. 6, the liner 51 is removed, the various adhesive pads are disengaged, and the seat member is turned to the position shown in FIG. 6. The support walls 39, 40 and 47 are then folded inwardly against the underside of the seat member, the walls 30, 31, 32, 33 of the structure folded flat, and the seat member 38 folded outwardly to lie against the outer side of wall 33. This is the compact disposition shown in FIG. 7.

By means of the invention there is provided a chamber pot for a child which is safe and easy to use, and is simply and easily foldable to a useful configuration for carrying and stowing in transport.

It is to be understood that the foregoing is merely exemplary of chamber pots in accordance with the invention and that modifications can readily be made thereto without departing from the true scope of the invention. Thus, for example, it is to be noted that the invention can be equally well applied to portable chamber pots for invalids or elderly people.

I claim:

1. A toilet pot comprising a structure including four rigid or semi-rigid upright structure walls, the upright structure walls comprising two side structure walls opposing each other, with each side structure wall formed of at least two panels hingedly connected together for folding inwardly, and a front structure wall and a rear structure wall opposing each other, the upright structure walls together defining a generally rectangular cavity, the opposing front and rear structure walls being pivotably connected together with the opposing side structure walls, a seat member hingedly connected to the upper edge of the rear structure wall for overlying the generally rectangular cavity, the seat member being provided with side support walls hingedly connected thereto and capable of folding down alongside of the side structure walls and engaging with the panels of the side structure walls such as to hold the side structure walls open while the toilet pot is in use, and a removable fluid impermeable lining bag being provided for insertion within the generally rectangular cavity defined by the upright structure walls.

2. A toilet pot as claimed in claim 1 wherein the side support walls fold down outside the side structure walls and are provided with flaps arranged to fold under lower edges of the side structure walls and attach to inner surfaces of the panels of the side structure walls.

3. A toilet pot as claimed in claim 1 wherein the seat member is provided with a front support wall capable of folding down outside of the front structure wall and engaging therewith.

* * * * *